US008695695B2

(12) United States Patent
Moeller et al.

(10) Patent No.: US 8,695,695 B2
(45) Date of Patent: Apr. 15, 2014

(54) DOWNHOLE TOOL WITH PUMPABLE SECTION

(75) Inventors: Daniel Keith Moeller, Edmond, OK (US); Shawn Ray Webb, Yukon, OK (US); Donald Ray Smith, Wilson, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 369 days.

(21) Appl. No.: 13/078,714

(22) Filed: Apr. 1, 2011

(65) Prior Publication Data

US 2012/0247775 A1 Oct. 4, 2012

(51) Int. Cl.
*E21B 33/12* (2006.01)
*E21B 43/26* (2006.01)

(52) U.S. Cl.
USPC ..... 166/118; 166/50; 166/127; 166/195; 166/153

(58) Field of Classification Search
USPC ..... 166/50, 118, 127, 195, 153, 308.1, 179
See application file for complete search history.

(56) References Cited

U.S. PATENT DOCUMENTS

| | | | | |
|---|---|---|---|---|
| 6,973,966 | B2 | 12/2005 | Szarka | |
| 7,096,949 | B2 | 8/2006 | Weber et al. | |
| 7,182,135 | B2 | 2/2007 | Szarka | |
| 7,584,792 | B2 | 9/2009 | Szarka | |
| 7,665,520 | B2 | 2/2010 | Szarka | |
| 7,686,092 | B2 | 3/2010 | Szarka | |
| 8,336,616 | B1 * | 12/2012 | McClinton | 166/135 |
| 2007/0181304 | A1 | 8/2007 | Rankin et al. | |
| 2008/0099206 | A1 * | 5/2008 | van Batenburg et al. | 166/305.1 |
| 2011/0079401 | A1 | 4/2011 | Gambier | |

FOREIGN PATENT DOCUMENTS

| | | | |
|---|---|---|---|
| GB | 2448960 | A | 11/2008 |
| WO | 9819042 | A2 | 5/1998 |
| WO | 03067016 | A2 | 8/2003 |

OTHER PUBLICATIONS

International Search Report and Written Opinion of the International Searching Authority dated Oct. 9, 2013, in related PCT Application No. PCT/US2012/071174.

* cited by examiner

*Primary Examiner* — Brad Harcourt
(74) *Attorney, Agent, or Firm* — McAfee & Taft; John Wustenberg

(57) ABSTRACT

A downhole tool for use in a well. The tool has a packer assembly and a pumpable plug associated with the packer assembly. The pumpable plug has a diameter greater than the maximum outer diameter of the packer assembly. The pumpable plug may be pumped through a casing having a diameter larger than that for which the packer assembly is designed and will urge the packer assembly through the large diameter casing into a smaller diameter casing for which the packer assembly is designed.

29 Claims, 4 Drawing Sheets

DOWNHOLE TOOL WITH PUMPABLE SECTION

BACKGROUND

This disclosure generally relates to tools used in oil and gas wellbores. More specifically, the disclosure relates to drillable packers and pressure isolation tools.

In the drilling and reworking of oil wells, a great variety of downhole tools are used. Such downhole tools often have drillable components made from metallic or non-metallic materials such as soft steel, cast iron or engineering grade plastics and composite materials. For example but not by way of limitation, it is often desired to seal tubing or other pipe in the well. It is desired to pump a slurry down the tubing and force the slurry out into a formation. The slurry may include for example fracturing fluid. It is necessary to seal the tubing with respect to the well casing and to prevent the fluid pressure of the slurry from lifting the tubing out of the well and likewise to force the slurry into the formation. Downhole tools referred to as packers, frac plugs and bridge plugs are designed for these general purposes and are well known in the art of producing oil and gas. Bridge plugs isolate the portion of the well below the bridge plug from the portion of the well thereabove such that there is no communication between the two well portions. Frac plugs, on the other hand, allow fluid flow in one direction but prevent flow in the other. For example, frac plugs set in a well may allow fluid from below the frac plug to pass upwardly therethrough but when the slurry is pumped into the well, the frac plug will not allow fluid flow therethrough so that any fluid being pumped down the well may be forced into a formation above the frac plug.

Wells drilled for the production of oil and/or gas often include a vertical portion and a deviated portion. The deviated portion is often horizontal or very nearly horizontal, and in some cases is past horizontal, so that it begins to travel upwardly toward the surface of the earth. The deviated section generally passes through the formation to be produced. The packer utilized to seal against the casing must be designed for the casing size in the deviated section of the well. Oftentimes, such wells will have different size casings. For example, the vertical section may have a larger diameter casing which will then transition to a small diameter casing which passes through the transition section, also referred to as a heel, into the deviated section of the well. In such cases, a tool, for example a packer designed for the horizontal section will pass through the larger section and then may be pumped around the heel into the horizontal section of the well.

There are circumstances, however, in which the larger diameter casing is installed not only in the vertical section of the well but in the transition section, or heel, and into the deviated section of the well. In such cases, a wire line cannot be used to lower the packer designed for the horizontal section into the horizontal section since the packer cannot be pumped around the heel into the horizontal section. While coiled or stick tubing can be used, use of a wire line is quicker, easier and less expensive. Thus, there is a need for packers and pressure isolation tools that can be pumped through one casing size and into a smaller casing size for which the tool is designed and in which the tool will operate properly.

SUMMARY OF THE INVENTION

The present disclosure provides a downhole tool for use in deviated wells with a vertical section and a deviated section. The downhole tool includes a packer. The packer is designed to set in a preselected casing having an inner diameter. The preselected casing will be installed in the deviated section of a well. A first or initial casing will be installed in the vertical section of the well. The first casing will also be installed in a transition section which may be referred to as a heel and will be installed in an initial portion of the deviated section. The first casing has an inner diameter larger than the inner diameter of the second or preselected casing. The packer is designed to set in the second casing. The inner diameter of first casing is such that the packer cannot be set therein. Thus, the inner diameter of the first casing is greater than a maximum expanded diameter of the packer designed to be set in the second casing. A compressible plug is operably associated with the packer. The compressible plug has an unrestrained outer diameter greater than a maximum inner diameter of the second casing. The compressible plug is pumpable through the first casing and is compressible such that it may be pumped into the second casing. The compressible plug will urge the packer through the first casing and into the second casing. In one embodiment, the compressible plug is positioned below the packer, and will pull the packer into the second casing.

DETAILED DESCRIPTION OF A PREFERRED EMBODIMENT

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not limit the scope of the present invention. Also, in the following discussion and in the claims, the terms "including" and "comprising" are used in an open-ended fashion, and thus should be interpreted to mean "including, but not limited to . . . ". Also, reference to "up" or "down" and "above" and "below" are made for purposes of ease of description with "up" and "above" meaning towards the surface, or the beginning of the wellbore, and "down" and "below" meaning towards the bottom, or end of the wellbore.

Figure 1:
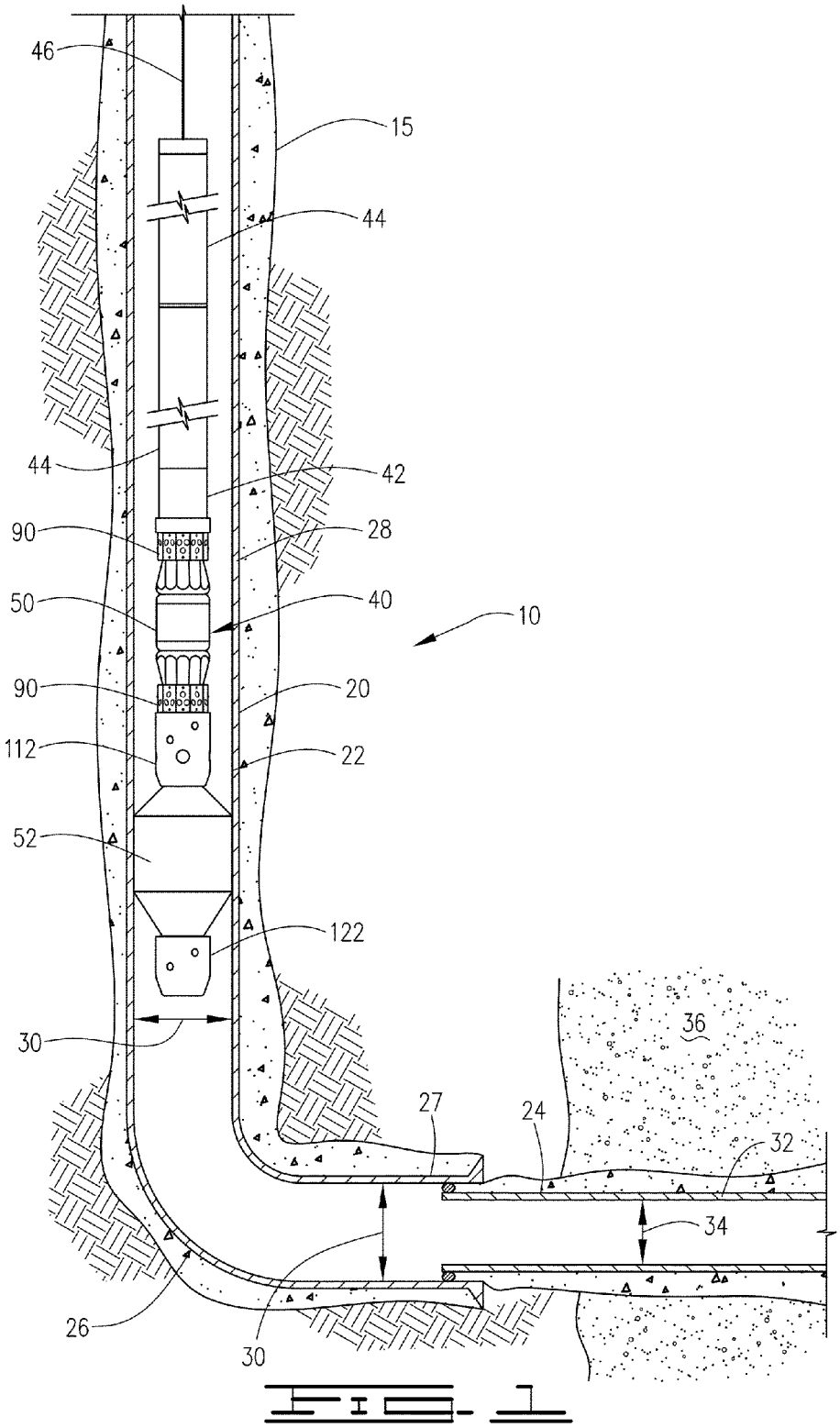
FIG. 1 schematically shows the tool of the present invention being lowered through a vertical section of a well bore that includes a vertical section and a horizontal section.
Figure 2:
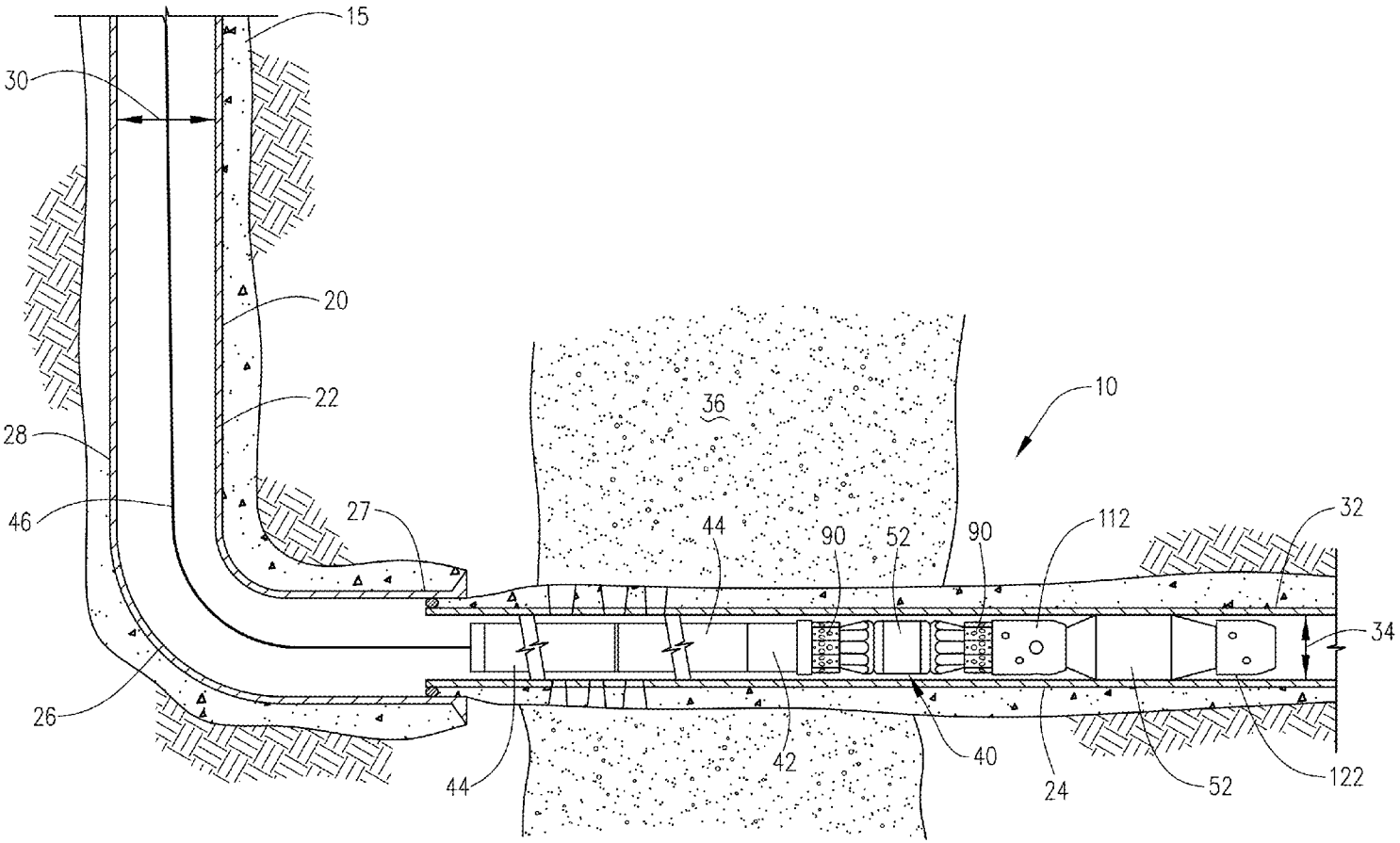
FIG. 2 schematically shows the tool positioned in the horizontal section of the wellbore.

Referring now to FIG. 1, well 10 is shown which comprises wellbore 15 and casing 20 cemented therein. Well 10 has a first or generally vertical section 22 and a second, or deviated section 24. Deviated section 24 may be generally horizontal as shown in FIG. 2, but it is understood that the deviated section may not reach horizontal, or may go past horizontal. Well 10 also includes a transition section 26 which may also be referred to as heel or heel section 26.

A first casing 28 having an inner diameter 30 extends from first section 22 through heel section 26 and into an initial portion 27 of second or deviated section 24. A second casing 32 is installed in deviated section 24 and has an inner diameter 34 which is smaller in magnitude than inner diameter 30 of first casing 28. Well 10 intersects formation 36. FIGS. 1 and 2 schematically show the connection of first casing 28 to second casing and the extension of second casing 34 farther into deviated section 24.

FIGS. 1 and 2 schematically show downhole tool 40 connected to setting tool 42 and perforating guns 44 which are in turn connected to wire line 46. Wireline 46 is utilized to lower tool 40 into well 10. It is understood that setting tool 42 and perforating guns 44 may be of a type known in the art. Perforating guns 44 will be utilized to perforate second casing 32 and setting tool 42 will be utilized in a manner known in the art to move tool 40 from an unset to a set position as will be explained in more detail herein.

Figure 4:
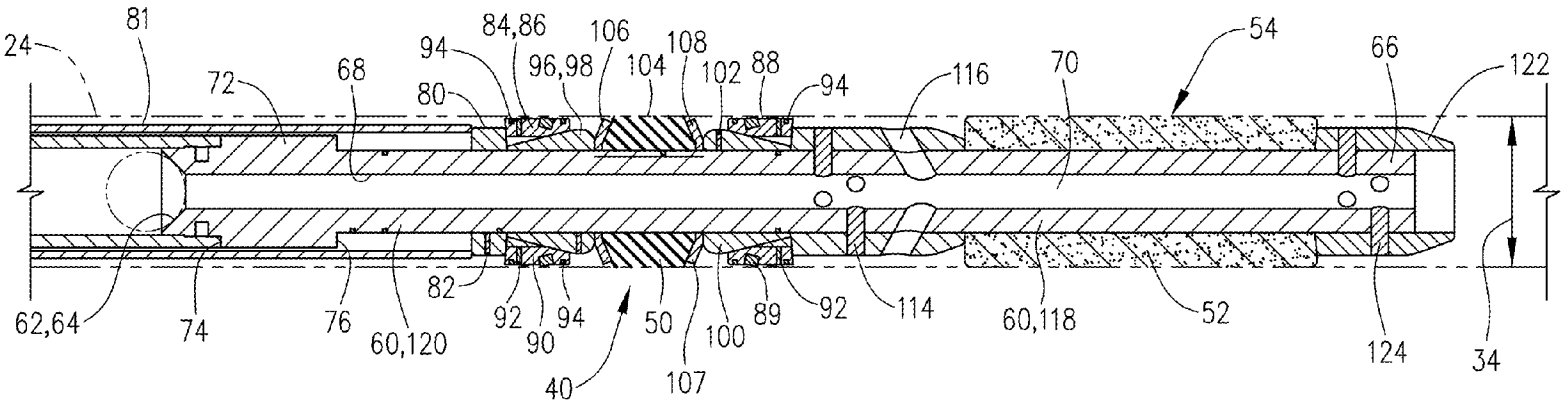
FIG. 4 is a cross section of the tool in the set condition after it has been pumped into the horizontal section of the well.

Tool 40 may comprise a packer assembly 50 and a pumpable plug 52. Pumpable plug 52 is a compressible plug and is therefore comprised of a compressible material, such as, for example, closed cell or open cell foam. Packer assembly 50 is movable from an unset position to a set position in the well which is shown in FIG. 4. As is apparent, packer 50 is designed to set in second casing 32 and so it is meant to be used in the smaller inner diameter casing 32 that is positioned in horizontal section 24.

Casing 32 will be a preselected casing having a known inner diameter range. Packer 50 will thus be a packer designed to set in casing 32. Casing 28, which may be referred to as the lead-in or initial casing, will likewise be a casing having a known inner diameter range. The minimum inner diameter of casing 28 will be larger than the maximum inner diameter of casing 32, and will be larger than a maximum expanded diameter of packer 50. Compressible plug 52 has an unrestrained outer diameter 54 that is larger than a maximum inner diameter 34 of second casing 32, and is large enough such that it may be pumped through inner diameter 30 of first casing 28 and compressible such that it may also be pumped through inner diameter 34 of second casing 32.

It is understood and known in the art that casing is typically provided in standard sizes. Tools are generally designed for casing of a particular size. When the inner diameter of a casing in which is tool is lowered is greater than that for which the tool is designed, it will be difficult and if the size is great enough perhaps impossible for the tool to pass through the heel section of the well. For example, first casing 28 may be a 7-inch casing which as known in the art has a range of inner diameters. Second casing 32 may be, for example, a 4½-inch casing which also may have a range of inner diameters. Casing is produced in different diameters, and different weights, which result in a particular casing having a range of inner diameters. Because tools such as packers are designed for specific casing sizes, packer assemblies like packer assembly 50 designed for a 4½-inch casing will have a diameter in the unset condition of something smaller than the smallest inner diameter of the casing for which it is designed. When a packer designed for a 4½ inch casing is lowered on a wire line into a deviated well like that shown in FIGS. 1 and 2, the packer will land in heel section 26. The packer will not be pumpable through transition section 26 or initial portion 27 of deviated section 24, since fluid pumped into the well will pass around the packer 50. The fluid will not be able to develop the velocity necessary to pump the packer into the second casing 32. While coiled or stick tubing may be used to perform the task, a wire line is quicker, easier and less expensive.

Utilizing pumpable section 52, fluid can be pumped into well 10 and will pump compressible plug 52 through transition section 26 and into and through the first casing 28 in initial portion 27 that extends into deviated section 24. Thus, outer diameter 54 will be such that the pumpable plug 52 is pumpable through the inner diameter of first casing 28 and is compressible enough so that it may be compressed and pumped through and into inner diameter 34 of second casing 32. Packer 50, in the absence of plug 52, is not pumpable through first casing 28, meaning that the space between the unset packer 50 and casing 28 is such that fluid in the well will not push the packer 50 through the casing 28. Thus, without the aid of plug 52, when packer 50 reaches transition section 26 it will stop moving. Even assuming the packer could pass through transition section 26, packer 50 nonetheless would then simply rest on the bottom side of casing 28 in initial portion 27, and would not be able to be pumped therethrough into casing 32.

As an example, the difference between inner diameters of casings 28 and 32 may be as much as about two and one-half or more inches, and the difference between the unrestrained outer diameter 54 of pumpable plug 52 and the maximum inner diameter of casing 32 may likewise be as much as about two and one-half inches. In any event, the difference in the inner diameters of the casings 28 and 32 is such that the packer 50 alone is not pumpable through casing 28. In the embodiment shown, pumpable plug 52 engages first casing 28, but it is understood that the diameter 54 must simply be large enough such that it may be pumped through casing 28 and into casing 32, and will pull packer 50 into casing 32 so that it may be moved to the set position therein.

Figure 3:
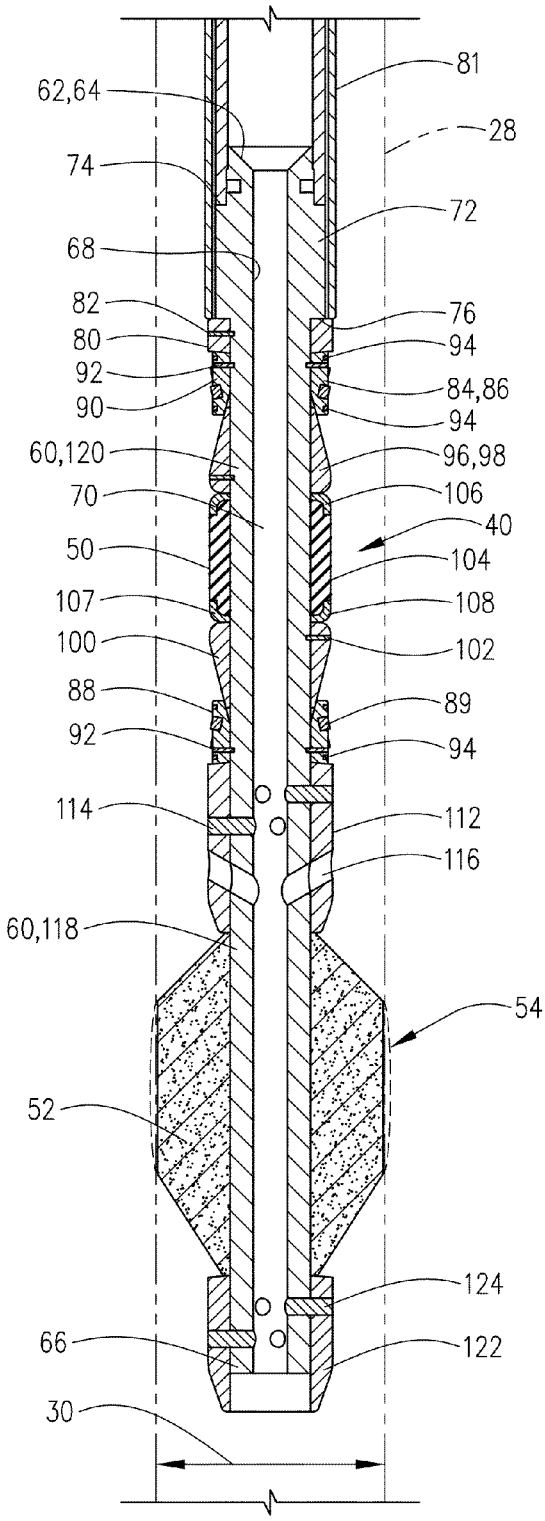
FIG. 3 is a cross section of the tool in a generally vertical position.

Referring now to FIG. 3, tool 40 comprises a mandrel having upper end 62 at which a seat 64 may be defined for receiving a closing device such as a frac ball as known in the art. Mandrel 60 has lower end 66 and bore 68 which defines central flow passage 70 therethrough. An enlarged head portion 72 defines an upwardly facing shoulder 74 and a downward facing shoulder 76. A spacer ring 80 is preferably secured to mandrel 60 with pins 82. Spacer ring 80 provides an abutment to axially retain a slip assembly 84 and more specifically an upper slip assembly 86. Spacer ring 80 also provides a surface to coact with a setting sleeve 81 when the tool is moved to the set position. Slip assemblies 84 may also include a lower slip assembly 88. Each of slip assemblies 84 may comprise a plurality of slip segments 90 that may be initially pinned with pins 92 to mandrel 60 to hold the slip segments 90 in place. Slip wedges 96, which may include upper and lower slip wedges 98 and 100 are initially positioned in slidable relationship and partially underneath upper and lower slip assemblies 86 and 88. Pins 102 may be utilized to pin the slip wedges in place. A sealing element, or packer element 104 is disposed about mandrel 60 and in the embodiment shown is positioned between upper and lower slip wedges 98 and 100, respectively. Although only one packer element or seal element 104 is shown a plurality of packer elements may be utilized. Seal element 104 has upper and lower ends 106 and 107, respectively. Extrusion limiters 108 are positioned at both the upper and lower ends 106 and 107 of the sealing element 104 to prevent or at least limit the extrusion of the sealing element 104.

A first shoe 112 which provides an abutment for lower slip assembly 88 is disposed about mandrel 60 and may be pinned thereto with pins 114. Flow ports 116 may be defined through first shoe 112 which may also be referred to as an upper shoe 112. Flow ports 116 extend through mandrel 60 to communicate with central flow passage 70. A second shoe which may be referred to as a lower shoe 122 is axially spaced from first shoe 112 and is disposed about and may be pinned to mandrel 60 with pins 124. Thus, mandrel 60 extends below first shoe 112. The portion of mandrel 60 extending below first shoe 112 may be referred to as a mandrel extension 118 while the portion from shoe 112 and thereabove may be referred to as packer mandrel 120. In the embodiment shown, packer mandrel 120 and mandrel extension 118 are integrally formed and are thus one continuous mandrel 60.

In operation, tool 40, comprising packer assembly 50 and pumpable plug 52 is lowered into well 10 through first section 22 in which casing 28 is installed. Outer diameter 54 of pumpable plug 52 is such that it will engage or at least nearly engage the inner diameter 30 of first casing 28 such that tool 40 is pumpable through first casing 28. Pumpable plug 52 because it is retained on mandrel 60 will pull packer assembly 50 therewith as it is pumped into the well 10. The inner diameter 30 of first casing 28 is such that the packer 50 is incapable of being set or operating properly therein. The maximum diameter to which packer assembly 50 can expand is smaller than the inner diameter 30. This is so because as explained herein, packer assembly 50 is designed to set and operate in the smaller inner diameter 34 of second casing 32 that is positioned in deviated section 24.

Pumpable plug 52 has an outer diameter 54 such that it is adapted to be pumped completely through first casing 28 including that portion of first casing 28 that passes through transition section 26 and into the initial portion 27 of horizontal section 24 of well 10. FIG. 2 schematically shows tool 40 after it is positioned in horizontal section 24 and it also schematically shows perforations through second casing 32 so the formation may be produced therefrom.

FIG. 4 shows tool 40 in the set position so that sealing element 104 engages casing 32 and slip assemblies 86 and 88 grip casing 32 to hold tool 40 therein. Compressible plug 52 is comprised of material that will compress and can be pumped through first casing 28 and second casing 32 and may be for example comprised of a closed cell foam. Packer 50 may be set in a manner known in the art utilizing a setting tool which has a setting kit 81 as shown in FIG. 4. Ports 116 allow the tool to be pumped into the second casing 32 past the desired setting location and then pulled upwardly if necessary. Flow ports 116 will allow flow from the well 10 into the longitudinal central flow passage 70 to allow the tool 40 to be pulled upwardly in casing 32.

The method thus includes lowering the packer 50 through casing 28 in the vertical section 22 of the well 10 and pumping the packer 50 through transition section 26 and initial portion 27 of deviated section 24. Once tool 40 is pumped to the desired location in casing 32, perforating guns 44 may be actuated, and setting tool 46 used to move packer 50 to the set position. A closing device, such as a closing ball can be dropped into the well to engage seat 64 to close off longitudinal passage 70. Pressure may then be increased to fracture the formation. While the present embodiment describes a ball dropped into the well 10, it is understood that the closing device may be carried into the well with the tool 40.

As explained herein, the packer 50 is designed to set in a specific size casing having an inner diameter range. Second casing 32 has a diameter such that packer 50 is capable of being properly operated and set therein. The range of deviation between the inner diameters 30 and 34 is such that the packer is incapable of being pumped through transition section 26 and initial portion 27 of the deviated section 24. Pumpable plug 52 allows a packer designed to be set in a casing much smaller than that utilized in the vertical section of the well to be pumped into a well utilizing a wire line as opposed to using jointed or coiled tubing. While the embodiment described herein includes a packer and a frac plug, it is understood that a solid plug can be utilized with packer 50 so that the tool acts as a bridge plug when set in well 10.

Likewise, while the compressible plug 52 is described for use with a packer having a sealing element, it is understood that the compressible plug 52 may be used in conjunction with other tools that cannot, without the aid of plug 52 be delivered into the casing for which the tool is designed. Thus, compressible plug 52 may be used to deliver tools through a large casing into a smaller casing, also referred to as a liner, for which the tool is designed.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A downhole tool for use in a deviated well having a first casing of a first designed size installed in a vertical section and a second casing of a second designed size installed in the deviated section of the well, wherein the first casing extends through a transition section and into an initial portion of the deviated section and the second casing extends farther into the deviated section, comprising:

a mandrel;

a sealing element disposed about the mandrel, the tool being adapted to be moved to a set position in the second casing wherein the sealing element will sealingly engage the second casing but will not expand sufficiently to sealingly engage the first casing; and a compressible plug that is pumpable through the first casing and sufficiently compressible to pump into the second casing, wherein the compressible plug will urge the sealing element into the second casing when the compressible plug is pumped into the second casing.

2. The downhole tool of claim 1, wherein the compressible plug is disposed about and retained on the mandrel below the sealing element, and wherein the compressible plug will pull the sealing element into the second casing when the compressible plug is pumped therein.

3. The downhole tool of claim 2, further comprising:

a slip segment assembly disposed about the mandrel below a lower end of the sealing element;

a first shoe disposed about the mandrel below the slip segment assembly; and a second shoe disposed about the mandrel and axially spaced from the first shoe, wherein the compressible plug is positioned between the first and second shoes.

4. The downhole tool of claim 1, wherein the plug is comprised of a closed cell foam.

5. The downhole tool of claim 1, wherein the compressible plug will compress at least one inch in diameter.

6. The downhole tool of claim 1, wherein the compressible plug will compress at least two inches in diameter.

7. The downhole tool of claim 1, wherein the first casing is a 7.0-inch casing and the second casing is a 4.5-inch casing, and the compressible plug is pumpable through the first casing and into the second casing.

8. A downhole tool for use in a well comprising:

a packer designed to set in a preselected casing having a known inner diameter ; and a compressible plug operably associated with the packer, the compressible plug having an unrestrained outer diameter greater than the inner diameter of the preselected casing, wherein the compressible plug is pumpable through an initial casing installed in the well leading into the preselected casing, the initial casing having an inner diameter greater than the inner diameter of the preselected casing such that the packer is not pumpable through the initial casing, wherein the compressible plug will urge the packer through the initial casing and into the preselected casing when the compressible plug is pumped through the initial casing and into the preselected casing.

9. The downhole tool of claim 8, wherein the compressible plug is positioned below the packer, and will pull the packer into the preselected casing.

10. The downhole tool of claim 9, the packer comprising:

a mandrel;

a sealing element disposed about the mandrel;

upper and lower slip assemblies disposed about the mandrel;

a first shoe disposed about the mandrel positioned below the lower slip assembly, wherein the mandrel comprises a packer mandrel and a mandrel extension; and a second shoe disposed about the mandrel extension, the compressible plug being positioned between the first and second shoes.

11. The downhole tool of claim 10 wherein the upper shoe prevents the lower slip assembly from movement downward relative to the mandrel.

12. The downhole tool of claim 10, wherein the upper shoe abuts the lower slip assembly.

13. The downhole tool of claim 9, wherein the preselected casing is in a deviated section of the well and wherein the initial casing is in a vertical section of the well and a transition section of the well, and wherein the initial casing extends into the deviated section of the well.

14. The downhole tool of claim 13 wherein the deviated section is substantially horizontal.

15. The downhole tool of claim 13, wherein the compressible plug is pumpable through a casing size range of 7.0 to 4.5 inches.

16. The downhole tool of claim 13, the compressible plug having an unrestrained diameter at least one inch larger than the maximum inner diameter of the preselected casing.

17. The downhole tool of claim 13, the compressible plug having an unrestrained diameter at least two inches larger than the maximum inner diameter of the preselected casing.

18. The downhole tool of claim 13, wherein the packer is designed for a 41;2-inch casing, and wherein the compressible plug is pumpable through casing up to at least 7 inches.

19. A downhole tool for use in a wellbore having a vertical portion with a first casing having a first diameter installed therein and a deviated portion with a second casing having a second diameter therein, the second diameter being smaller that the first diameter, wherein the tool is designed to move from an unset to a set position in the second casing, comprising:

a packer comprising;

a mandrel defining a flow passage therethrough;

a sealing element for sealingly engaging the second casing when the tool is moved to the set position in the second casing;

upper and lower slip assemblies for grippingly engaging the second casing in the well and for holding the tool in place when the tool is in the set position; and a first shoe disposed about the mandrel below the lower slip assembly, wherein the first casing extends through a transition section of the well and into a lead-in portion of the deviated section of the well, the inner diameter of the first casing being sufficiently larger than the outer diameter of the packer such the packer is not pumpable with fluid through the first casing in the transition section and the lead-in portion of the deviated section of the well; and a compressible plug disposed about the mandrel below the packer, the compressible plug being pumpable through the first casing and into the second casing in the deviated section of the wellbore.

20. The tool of claim 19, wherein the deviated portion of the well is substantially horizontal.

21. The tool of claim 19 further comprising a second shoe connected to the mandrel, the compressible plug being retained on the mandrel by the first and second shoes.

22. The tool of claim 19, wherein the first casing having an inner diameter of at least one inch greater than inner diameter of the second casing.

23. The tool of claim 19, wherein the first casing is a 7 inch casing and the second casing is a 41;2-inch casing.

24. The tool of claim 19, wherein the compressible plug is comprised of closed cell foam.

25. A method of fracturing a well having a vertical section and a deviated section wherein a first casing is installed in the vertical section and an initial portion of the deviated section and a second casing extends in the well from the first casing in the deviated portion, and wherein the first casing has an inner diameter greater than the second casing such that a packer designed to set in the second casing will not expand to engage the first casing, comprising the steps of:

lowering a packer designed to set in the second casing through the vertical sectionof the well;

pumping the packer through a transition section connecting the vertical section and the deviated section, and through the first casing into the second casing;

closing off an axial flow passage through the packer; and increasing the pressure in the well to fracture a zone above the packer.

26. The method of claim 25, further comprising:

perforating the well above the packer; and setting the packer in the second casing.

27. The method of claim 25, the pumping step comprising:

connecting a compressible plug to the packer;

pumping the compressible plug through the first casing into the second casing; and pulling the packer through the transition section and into the second casing with the compressible plug.

28. The method of claim 27, wherein the inner diameter of the first casing is at least one inch greater than the inner diameter of the second casing.

29. The method of claim 25, wherein the closing step comprises engaging an upper end of the packer with a closing device.

* * * * *